US006499737B2

(12) United States Patent
Slocum et al.

(10) Patent No.: US 6,499,737 B2
(45) Date of Patent: Dec. 31, 2002

(54) FLAT MAIL ANTI-ROLLOVER MECHANISM

(75) Inventors: Douglas A. Slocum, New Milford, PA (US); Wayne M. Blackwell, Chenango Forks, NY (US); Patrick J. Fitzgibbons, Newark Valley, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 97 days.

(21) Appl. No.: 09/797,686

(22) Filed: Mar. 5, 2001

(65) Prior Publication Data

US 2002/0121738 A1 Sep. 5, 2002

(51) Int. Cl.[7] ..... B65H 29/70
(52) U.S. Cl. ..... 271/188
(58) Field of Search ..... 271/161, 188

(56) References Cited

U.S. PATENT DOCUMENTS 3,749,398 A * 7/1973 Fujita et al. ..... 271/180
3,931,963 A 1/1976 Bewersdorf
4,332,581 A 6/1982 Thompson
4,588,393 A 5/1986 Cogswell et al.
4,795,416 A 1/1989 Cogswell et al.
4,863,152 A 9/1989 Milo
4,995,859 A * 2/1991 Totani ..... 271/182
5,257,492 A 11/1993 Watts
5,358,231 A * 10/1994 Andela ..... 271/176
5,468,525 A 11/1995 Watts

FOREIGN PATENT DOCUMENTS

JP 5-294542 * 11/1993

* cited by examiner

*Primary Examiner*—Donald P. Walsh
*Assistant Examiner*—Kenneth W. Bower
(74) *Attorney, Agent, or Firm*—Schwartz & Weinrieb

(57) ABSTRACT

A flat article conveyor system comprises a forming wheel which is provided for operative cooperation with a grooved roller whereby a relatively shallow and temporary longitudinal crease, rib, or spine is formed or impressed within relatively thin pieces or units of mail, or similar flat articles, as the pieces or units of mail, or similar flat articles, are conveyed so as to effectively reinforce the piece or unit of mail, or similar article, such that the piece or unit of mail will not experience curl or sag so as not to subsequently rollover when, for example, the particular piece or unit of mail, or similar flat article, is being released from a conveyor mechanism into a stacking or similar accumulation chamber.

20 Claims, 3 Drawing Sheets

FLAT MAIL ANTI-ROLLOVER MECHANISM

FIELD OF THE INVENTION

The present invention relates generally to flat article conveying or transporting systems, and more particularly to a new and improved system for use within, for example, mail sorting, transporting, handling, and stacking systems wherein flat mail pieces or units, or similar articles, such as, for example, post cards, magazines, and the like, which would otherwise tend to roll over on themselves in a semi-circular form, as a result of being pre-curled, or as a result of undergoing curvature or sagging, after being released from its conveyor mechanism and introduced into a stacking chamber or compartment within which a stack of mail pieces or articles are accumulated, are effectively prevented from undergoing or experiencing such rollover so as not to adversely affect the continuous mail sorting, transporting, handling, and stacking operations.

BACKGROUND OF THE INVENTION

In connection with mail or similar flat article sorting, transporting, stacking, and handling systems, flat units or pieces of mail, or similar articles, are conventionally transported by means of a suitable conveyor, such as, for example, a belt conveyor comprising a plurality of laterally spaced endless belts, and the transported pieces of mail or similar articles are then adapted to be stacked within stacked arrays or piles formed within a stacking chamber or receptacle compartment. In view of the fact that different types of pieces or units of mail, or similar articles, having, for example, different size or length dimensions, are being continuously conveyed or transported by means of the transport conveyor mechanism toward and into the stacking chamber or compartment, care must be taken so as to ensure the fact that the pieces or units of mail, or similar articles, are in fact serially placed upon each other in a flat stacked array. This mode of operation, however, is not always able to be readily achieved, and therefore, problems or difficulties often occur in connection with maintaining the system continuously operative with minimum operational downtime.

For example, in connection with the conveyance, transportation, and handling of conventional stiff post cards, and due to the inherent structural characteristics of stiff post cards, that is, that they exhibit a somewhat greater degree of rigidity than, for example, twenty pound weight paper or the like, as a result of being fabricated from a different type of paper product than, for example, twenty pound weight paper, post cards are easily bent and also tend to exhibit or undergo curling. Similarly, magazines have a relatively low degree of rigidity and therefore tend to readily curve downwardly or sag. Accordingly, when such flat articles are being transported or conveyed within a conventional mail sorting, transporting, stacking, and handling system, they can cause operational problems or difficulties because they do not tend to remain in a relatively flattened state. More particularly, when such flat articles are released from the belted conveyor transport and allowed to fly toward and into the stacking chamber or compartment so as to be placed flatly on top of or into a stacked array within the stacking chamber or compartment, the curling of the flat articles often causes leading edge portions of the flat articles to roll over onto themselves in flight or to trip and roll over when encountering a trailing edge portion of a previously stacked flat article within the stacking chamber or compartment.

As a result of such encounter, the incoming flat article is not in fact deposited, in a face up flat orientation, on top of the stacked array of previously stacked units or pieces, or similar articles, or is improperly deposited upon the stacked array of mail pieces or units, whereby subsequent flat articles are not properly deposited upon the stacked array of previous flat articles. In this case, jamming of the conveyor and stacking system can occur necessitating an operational stoppage of the system until the jammed state of the mail pieces or units, or similar flat articles, is able to be rectified. Equally important, even if a jam does not occur, subsequent mail fed to the stack will not always come to rest fully and completely on top of the previously curled piece which had come to rest in a semi-circular form because such curled piece then causes the following piece of mail to nest inside of it. This nesting of the following piece partially inside of the previous semi-rolled-over piece causes an out of order mixed situation to occur with respect to the previously serially sorted flat articles.

A need therefore exists in the art for a new and improved article conveyor or transportation system, particularly a conveyor or transportation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber or compartment in a substantially flat state regardless of the inherent tendency of the particular pieces or units of mail, or similar flat articles, to either curl, curve, or sag, causing partial or complete rollovers, whereby the pieces or units of mail, or similar articles, can be properly stacked within the stacking chamber or compartment so as not to cause any hindrance to the continuous conveyance or transportation of the pieces or units of mail, or similar flat articles, whereby, further, the article conveyor or transportation system can operate in a substantially continuous manner without experiencing any jamming and wherein the flat articles all stack serially in their previously sorted order.

OBJECTS OF THE INVENTION

Accordingly, it is an object of the present invention to provide a new and improved article conveyor or transportation system which is especially useful in connection with the sorting, transporting, handling, and stacking of pieces or units of mail, or similar flat articles.

Another object of the present invention is to provide a new and improved article conveyor or transportation system which is especially useful in connection with the sorting, transporting, handling, and stacking of pieces or units of mail, or similar articles, and which effectively overcomes the various disadvantages or drawbacks characteristic of current conventional article sorting, transporting, handling, and stacking systems.

An additional object of the present invention is to provide a new and improved article conveyor or transportation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber or compartment in a substantially flat state regardless of the inherent tendency of the particular pieces or units of mail, or similar articles, to either curl, curve, or sag, causing partial or complete rollovers, whereby the pieces or units of mail, or similar articles, can be properly serially stacked within the stacking chamber or compartment.

A further object of the present invention is to provide a new and improved article conveyor or transportation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber or compartment in a substantially flat state regardless of the inherent tendency of the particular pieces or units of mail, or similar articles, to either curl, curve, or sag, causing partial or complete rollovers, whereby the pieces or units of mail, or similar articles, can be properly stacked within the stacking chamber or compartment so as not to cause any hindrance to the continuous conveyance or transportation of the pieces or units of mail, or similar flat articles, whereby, further, the article conveyor or transportation system can operate in a substantially continuous manner without experiencing any jamming so as to obviate or render unnecessary required maintenance in order to rectify the problem and to additionally eliminate any operational downtime of the apparatus or system.

SUMMARY OF THE INVENTION

The foregoing and other objectives are achieved in accordance with the teachings and principles of the present invention through the provision of a new and improved article conveyor or transportation system which is especially useful in connection with the sorting, transporting, handling, and stacking of different pieces or units of mail, or similar articles, and which comprises a belt conveyor for conveying or transporting the pieces or units of mail, or similar articles, and a stacking chamber or compartment within which the conveyed or transported pieces or units of mail, or similar articles, are stacked. In accordance with the principles and teachings of the present invention, the system comprises a mechanism by means of which a temporary longitudinal crease, spine, or rib is effectively formed or impressed into the piece or unit of mail, or similar flat article. In this manner, the crease, spine, or rib effectively rigidifies the piece or unit of mail, or similar flat article, so as to prevent any downward curling, curving, or sagging of the particular piece or unit of mail, or similar article, whereby the particular piece or unit of mail, or similar flat article, effectively maintains a substantially flattened state so as to be delivered from the belt conveyor and into the stacking chamber or compartment in a proper disposition. Accordingly, continuous stacking of the various pieces or units of mail, or similar articles, can be serially and continuously achieved without the system experiencing jamming and consequent operational stoppages and necessary downtime due to the need for maintenance or repair, and in addition, the flat articles are stacked flat and serially as pre-sorted without undesired intermixing.

The mechanism for achieving the formation of the crease, spine, or rib within the particular piece or unit of mail, or similar article, comprises a forming wheel which is pivotally mounted upon a support wall of the conveyor system and which is adapted to cooperate with a groove in a roller which is rotatably mounted upon a leading edge support bar of the belt conveyor section disposed immediately upstream of the stacking chamber or compartment. A lifter wheel or roller is operatively associated with and disposed upstream of the forming wheel, and the lifter wheel or roller is adapted to engage relatively thick pieces or units of mail, or similar articles, so as to elevate the forming wheel above the relatively thick piece or unit of mail, or similar article, whereby the forming wheel is effectively removed from its cooperative disposition with respect to the grooved roller such that the relatively thick piece or unit of mail, or similar article, will not have a crease, rib, or spine impressed or formed therein in view of the fact that such relatively thick piece or unit of mail, or similar article, does not require such a crease, spine, or rib to be formed therein in order to maintain its substantially rigidity and flattened state. In accordance with an alternative embodiment, the upstream lifter wheel or roller can be eliminated and a suitable actuator can be operatively associated with the forming wheel for lifting the forming wheel out of engagement with the grooved roller when, for example, a piece or unit of mail, or similar article, having a predeterminedly sensed thickness dimension, is detected.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
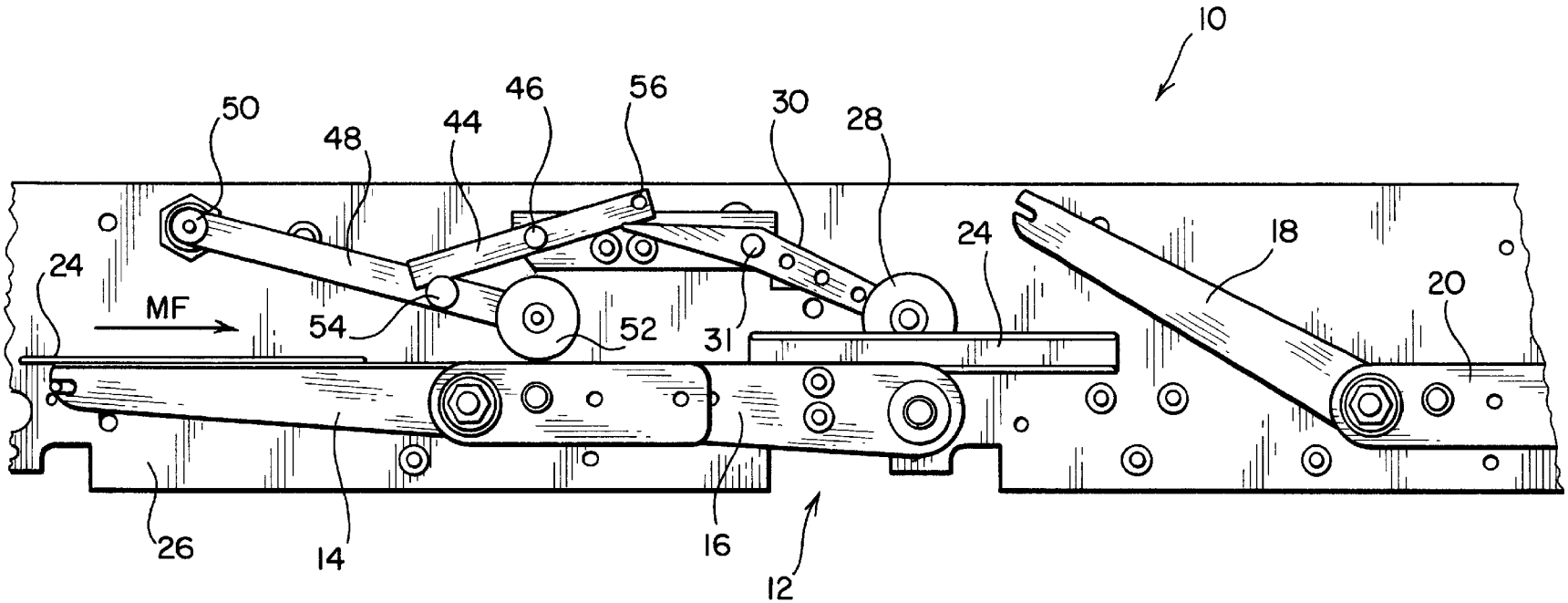
FIG. 1 is a right side elevational view of the new and improved article conveyor or transportation system which has been constructed in accordance with the principles and teachings of the present invention and which includes the crease, rib, or spine-forming wheel disposed in cooperation with the grooved roller for impressing a crease, rib, or spine into a relatively thin piece or unit of mail, or similar article, so as to effectively prevent the downward curling, curving, or sagging of pieces or units of mail, or similar flat articles, when the pieces or units of mail, or similar flat articles, are being transported from the belt conveyor into the stacking chamber or compartment.
Figure 2:
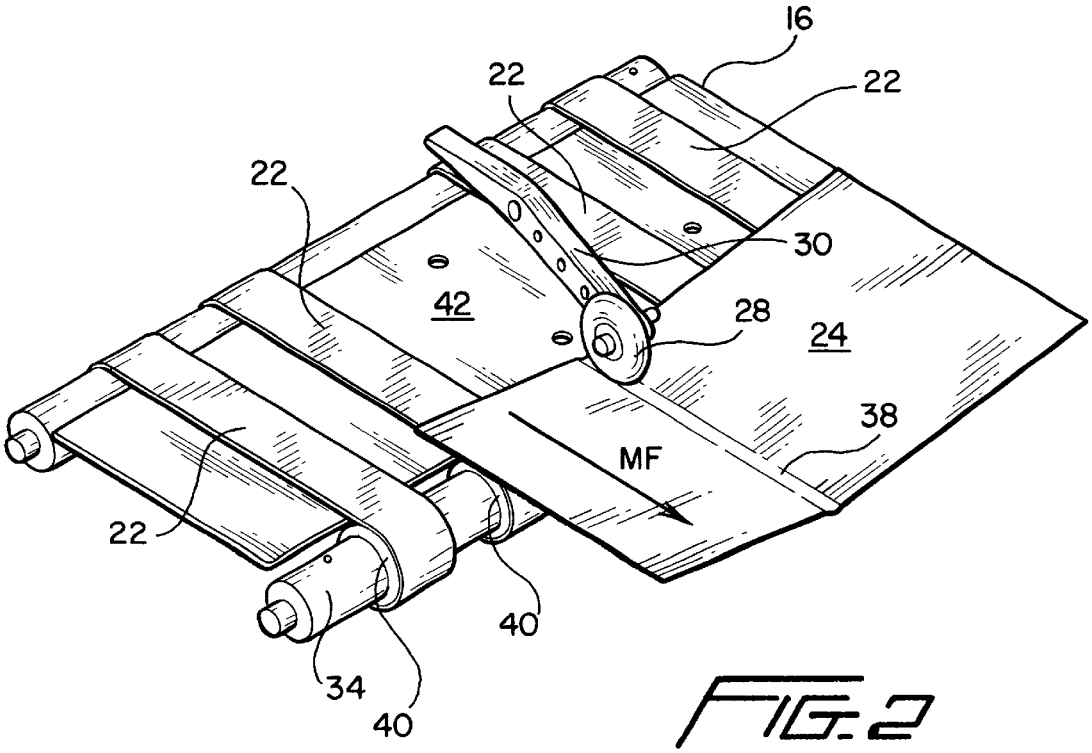
FIG. 2 is a partial, right side perspective view of the new and improved article conveyor or transportation system disclosed within FIG. 1.
Figure 3:
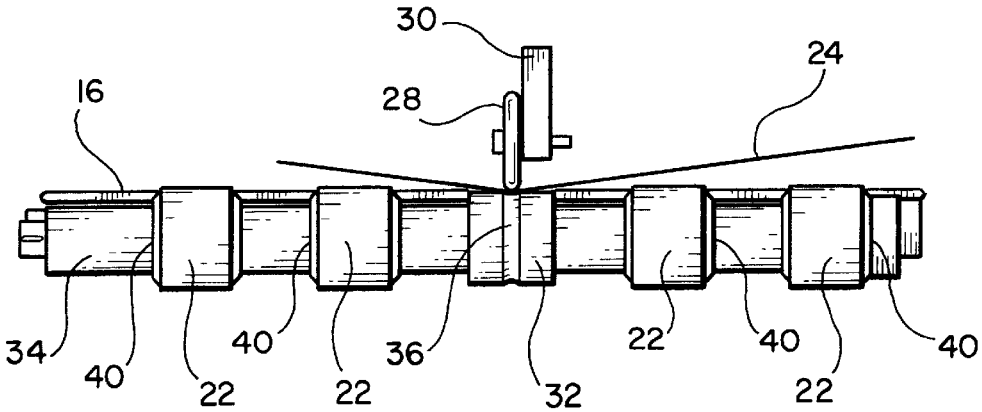
FIG. 3 is a front elevational view corresponding to that of FIG. 2 showing the belt conveyor roller shaft and the grooved roller mounted thereon in operative cooperation with the crease, rib, or spine-forming wheel.

Referring now to the drawings, and more particularly to FIGS. 1–3 thereof, the new and improved article conveyor or transportation system, which has been developed in accordance with the principles and teachings of the present invention, is disclosed and is generally indicated by the reference character 10. As can readily be appreciated from the drawing figures, the new and improved article conveyor or transportation system 10 of the present invention is especially useful in connection with the conveyance or transportation, sorting, and stacking of pieces or units of mail, or similar articles, particularly thin flat mail, such as, magazines, fliers, or the like, which often have unique problems or difficulties in maintaining their flat state. As has been noted hereinbefore, magazines and other thinner flat mail have a tendency to curve downwardly or sag, as well as a tendency to become curled, and when such articles are curled downwardly, then both the thin flat articles and magazines often present problems in connection with the conveyance and stacking of the same within, for example, mail sorting and handling systems. The present invention apparatus or system has been developed in order to effectively address this problem.

Accordingly, it is to be further appreciated that the new and improved flat article conveyor or transportation system 10 is seen to comprise a belt conveyor 12 which, in turn, comprises a plurality of belt conveyor sections 14,16, 18,20. Each belt conveyor section 14,16,18,20 comprises a plurality of laterally spaced, endless conveyor belts 22, and as is well known in the art, the conveyor belts 22 are driven by suitable motor-drive means, not shown. The conveyor belts 22 are adapted to serially convey or transport, in a longitudinally spaced fashion or mode of operation, various different pieces or units of flat mail, or similar flat articles, such as, for example, fliers, magazines, and the like, in the downstream direction indicated by the arrow MF, and such pieces or units of mail, or similar articles, are generally shown and indicated at 24. As is also well known in the art, conveyed articles of the type with which the present invention is concerned are often sorted by means of automatic light beam transceiver devices and operatively associated software-controlled systems, not shown and not the subject of the present invention, and the sorted articles are then routed into particular receptacles or compartments so as to be stacked in preparation for further transportation, dissemination, distribution, or the like. Accordingly, one of the belt conveyor sections, such as, for example, diverter conveyor section 18, may be mounted within the belt conveyor 12 so as to be pivotally movable into and out of the plane of the belt conveyor 12.

When the diverter conveyor section 18 is disposed in a coplanar mode with respect to the other belt conveyor sections 14,16, and 20, then pieces or units of mail, or similar articles, 24 continue to be conveyed in the downstream direction MF. When the diverter conveyor section 18, however, is disposed in a non-coplanar mode with respect to the other belt conveyor sections 14,16, and 20, as illustrated, for example, within FIG. 1, then diverter conveyor section 18 is disposed in a divert mode whereby the pieces or units of mail, or similar articles, 24 may be conducted, conveyed, or diverted, for example, into an accumulation chamber or compartment, not shown, which is provided in conjunction with the belt conveyor 12, for accumulating and stacking a plurality of the pieces or units of mail, or similar articles, 24 in a stacked or piled array. As can be especially appreciated from FIG. 1, the article conveyor or transportation system 10 further comprises a vertically disposed support wall 26, and the stacking chamber or compartment, not shown, is adapted to be fixedly mounted upon the support wall 26 by means of suitable mounting brackets, also not shown. When it is desired to collect or accumulate the pieces or units of mail, or similar articles, 24 in a stacked array within the stacking chamber or compartment, not shown, conveyor belt section 18 is pivotally moved to its partially open, inclined divert position as shown in FIG. 1 whereby the pieces or units of mail, or similar articles, 24 are able to be conveyed from the belt conveyor section 16 and into the stacking chamber or compartment, not shown, so as to be deposited either onto the floor member of the stacking chamber or compartment or onto the uppermost one of the pieces or units of mail, or similar articles, 24 disposed upon the stacked array of mail or articles disposed within the stacking chamber or compartment, not shown.

As has been noted hereinbefore, when the various pieces, articles, or units of mail 24 are being conveyed into the stacking chamber or compartment, not shown, it often happens that the leading end portion, for example, of some incoming piece of mail, or similar article, 24 tends to curl, curve downwardly, or sag as the same leaves the belt conveyor section 16, and if such curl, curvature, or sagging is significant, the piece of mail or similar article 24 could in effect roll over upon itself and either be deposited upon the stack of mail disposed within the stacking chamber or compartment, not shown, in such rolled-over state, or alternatively, could become, in effect, lodged within a space which is defined between the trailing or upstream end of the stack of mail and the upstream or trailing end wall of the stacking chamber or compartment, not shown. In either case, the disposition of such rolled-over article or piece of mail 24 will present free-flowing or continuous conveyance problems with respect to subsequently conveyed or upstream pieces or units of mail, or similar articles, 24. Eventually, the conveyor system 12 may become jammed, and personnel will have to be summoned in order to service the conveyor 12, necessitating operational stoppage of the conveyor 12 and operational downtime with respect to the entire conveyor system 12. Equally important, subsequent mail following a partially rolled-over piece may not be deposited on top of the curled piece but may nest inside of it whereby the mail pieces will not be in the previously sorted serial order.

Accordingly, the anti-rollover mechanism has been developed in accordance with the principles and teachings of the present invention so as to specifically address the aforenoted rollover problem characteristic of relatively thin conveyed or transported pieces or units of flat mail, or similar flat articles. More particularly, then, with reference now being made specifically to FIGS. 1–3, the anti-roll-over mechanism of the present invention is seen to comprise a crease, rib, or spine-forming wheel 28 which is circular, which is rotatably mounted upon a leading or downstream end portion of a first lever arm 30, and which is adapted to temporarily form or impress a longitudinally extending relatively shallow crease, rib, or spine within, for example, a relatively thin piece or unit or mail, or similar article, 24 so as to effectively longitudinally reinforce the piece or unit of mail, or similar article, 24 whereby the piece or unit of mail, or similar article, 24 will not undergo or experience downward curling, curving, or sagging. The first lever arm 30 is pivotally mounted upon the support wall 26 by means of a pivot axle 31, and as best seen from FIGS. 2 and 3, the spine-forming wheel 28 is adapted to operatively cooperate with a grooved roller 32 which is rotatably mounted upon a roller shaft 34 which is disposed at the downstream end of the conveyor belt section 16, the grooved roller 32 having an annular groove 36 defined within the outer periphery of the roller 32 and within which the outer periphery of the spine-forming wheel 28 is adapted to be operatively disposed or seated as best seen in FIG. 3. In this manner, when a relatively thin piece or unit of mail, or similar flat article, 24 is conveyed downstream by means of the belt conveyor 12, particularly the conveyor belt section 16, and is conducted into and through the nip formed by means of the operatively cooperative peripheral surfaces of the spine-forming wheel 28 and the grooved roller 32, a longitudinally extending crease, rib, or spine 38 is temporarily formed within the particular unit or piece of mail, or similar article, 24 as best seen in FIG. 2 so as to effectively longitudinally reinforce the particular unit or piece of mail, or similar article 24, whereby the piece or unit of mail, or similar article 24, will not undergo downward curling, curving, or sagging. Accordingly, when the creased piece or unit of mail, or similar article, 24 is to be conducted into the associated stacking chamber, not shown, the creased piece or unit of mail, or similar article, 24 will not experience or undergo rollover so as not to adversely affect the stacking of a multitude of pieces or units of mail, or similar articles, 24 within the stacking chamber, and similarly will not ultimately adversely affect the continuous free-flowing conveyance and serial stacking of the pieces or units of mail, or similar flat articles, 24.

It is noted in conjunction with the formation of the crease, rib, or spine 38 within a particular piece or unit of mail, or similar article, 24 that, as may best be appreciated from FIGS. 2 and 3, in order for the particular piece or unit of mail, or similar article 24, to be properly creased and reinforced, the crease, rib, or spine 38 need not necessarily be formed within an axially laterally central portion of the piece or unit of mail, or similar article, 24 but may in fact be formed or impressed within, in effect, an asymmetrically located portion of the piece or unit of mail, or similar article, 24. In addition, as may best be appreciated from FIG. 2, it is seen that the conveyor belts 22 are normally routed around laterally spaced rollers 40 which are rotatably mounted upon, for example, the downstream roller shaft 34, and that in accordance with a first embodiment of the present invention, the grooved roller 32 has in effect been formed from one of the conventional conveyor belt rollers 40, or alternatively, has replaced one of the conventional conveyor belt rollers 40.

Accordingly, it can also be seen that the conveyor belt 22 which would normally be routed around the grooved roller 32 has been removed, however, in accordance with an alternative embodiment, not illustrated, it is further contemplated, in accordance with the principles and teachings of the present invention, that all of the conventional rollers 40 and their associated conveyor belts 22 can be maintained upon the roller shaft 34 while the grooved roller 32 can actually be added to the roller shaft 34 by rotatably mounting the same at an axial position along roller shaft 34 which is interposed between adjacent rollers 40. It is further noted that in the instance that the conveyor belt 22 has been removed and is absent, as is shown in FIG. 2, such absence of the belt 22 does not adversely affect the conveyance of the units or pieces of mail, or similar articles, 24 because the mail units or pieces, or similar articles, 24 extend laterally across other ones of the plurality of conveyor belts 22. In addition, the conveyor belt section 16 also comprises a stainless steel plate 42 which would effectively prevent any downward drooping or sagging of the relatively central region of a particular piece or unit of mail, or similar article, 24 between those conveyor belts 22 which are now spaced from each other by means of an abnormally large distance due to the removal of the central conveyor belt 22 as has been noted. Still further, the plate 42 likewise prevents any particular piece or unit of mail, or similar article, 24, which may have a relatively small width dimension, from dropping down or falling between the laterally spaced conveyor belts 22.

Figure 4:
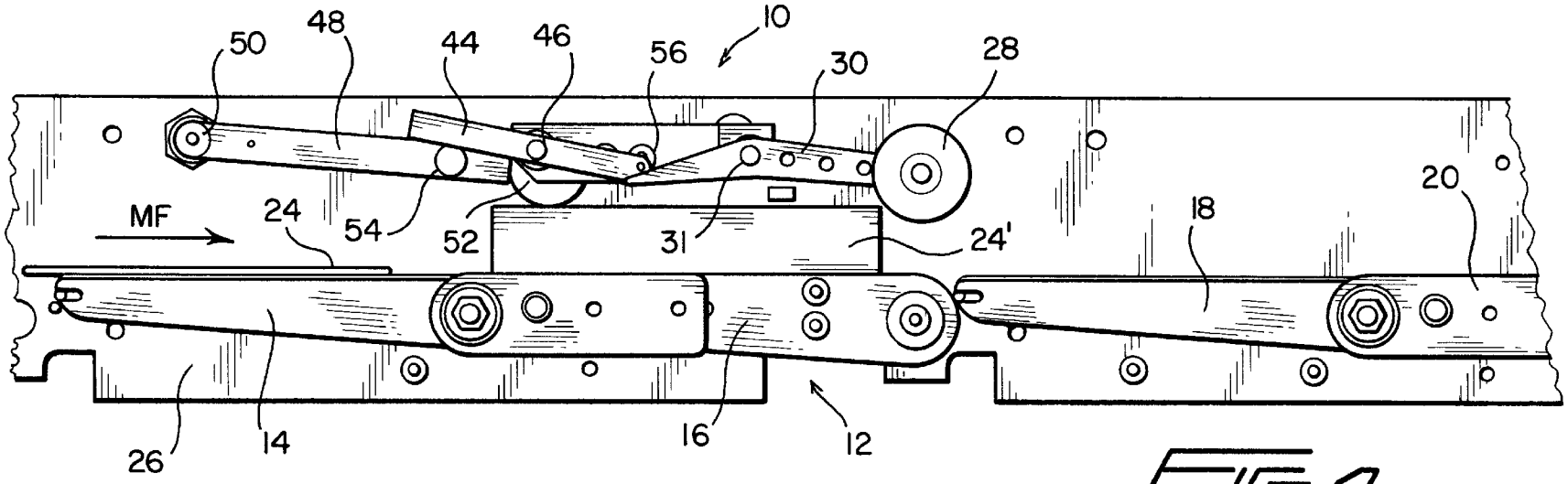
FIG. 4 is a right side elevational view similar to that of FIG. 1 showing, however, the operation of the upstream lift wheel mechanism and the resulting disposition of the downstream forming wheel when a relatively thick unit or piece of mail, or similar article, is being transported or conveyed along the belt conveyor.

With reference now being made to FIGS. 1 and 4, it is further seen that the crease-forming wheel 28 is operatively part of a lever actuation system in order to optimally elevationally dispose the forming wheel 28 with respect to the pieces or units of mail, or similar articles, 24 depending upon the thickness dimensions of the pieces or units of mail, or similar articles, 24. For the purposes of this invention, it has been determined that if a particular piece or unit of mail, or similar article, 24 has a thickness dimension of, for example, three-sixteenths of an inch (3/16") or less, then that particular piece or unit of mail, or similar article, 24 should have a crease, rib, or spine 38 formed therein in order to reinforce the same. Conversely, if a particular piece or unit of mail, or similar article, 24 has a thickness dimension greater than the noted three-sixteenths of an inch (3/16"), then it is not necessary to form or impress a crease, rib, or spine upon that particular piece or unit of mail, or similar article, 24 in view of the fact that such a relatively thick piece or unit of mail, or similar article, 24 has a sufficient amount of natural rigidity and therefore does not need to have a reinforcing crease, rib, or spine 38 formed therein in order to prevent downward curl and potential rollover. Consequently, if a particular piece or unit of mail, or similar article, 24 is in fact to have a reinforcing crease, rib, or spine 38 formed therein, then it is desired to maintain the crease-forming wheel 28 at an elevationally lowered position such that the forming wheel 28 is disposed in contact with the grooved roller 32 whereby the reinforcing crease, rib, or spine 38 will be formed within the piece or unit of mail, or similar article, 24 when the piece or unit of mail, or similar article, 24 is conducted through the nip defined between the forming wheel 28 and the grooved roller 32.

Alternatively, if a particular piece or unit of mail, or similar article, 24 is not in fact to have a reinforcing crease, rib, or spine 38 formed therein, then it is desired to maintain the crease-forming wheel 28 at an elevationally raised position such that the forming wheel 28 is disposed out of contact with the grooved roller 32 whereby the reinforcing crease, rib, or spine 38 will not be formed within the piece or unit of mail, or similar article, 24 when the piece or unit of mail, or similar article, 24 is conducted along the conveyor 12 between the forming wheel 28 and the grooved roller 32. With reference therefore again being made to FIGS. 1 and 4, it is seen that, in conjunction with the first lever 30 upon which the forming wheel 28 is mounted, there is additionally provided a second lever arm 44 which is pivotally mounted at a substantially central portion thereof upon the upstanding support wall 26 by means of an axle or trunnion 46, and a third actuating lever arm 48 which is likewise pivotally mounted at the left end portion thereof upon the upstanding support wall 26 by means of an axle or trunnion 50. The actuating lever arm 48 is biased toward its downward or lowered position as illustrated in FIG. 1 by means of a torsion spring, not shown, operatively associated with the pivot axle or trunnion 50, and it is seen that the opposite right end portion of the actuating lever arm 48 is provided with a lifter wheel 52.

In addition, the actuating lever arm 48 is also provided with a laterally or transversely projecting dowel or rod member 54, and it is seen that the laterally or transversely projecting dowel or rod member 54 is disposed beneath the left end portion of the second lever arm 44 such that, for example, the left end portion of the second lever arm 44 is normally disposed in contact with, or rests upon, the dowel or rod member 54. The right end portion of the second lever arm 44 is similarly provided with a laterally or transversely extending dowel or rod member 56, and it is seen that the dowel or rod member 56 is normally disposed above and out of contact with the left end portion of the first lever arm 30. The first lever arm 30 is normally biased downwardly toward its lowered position as illustrated in FIG. 1, so as to be disposed in contact with the grooved roller 32, either under the influence of gravity as a result of the weight and moment arm of the forming wheel 28 relative to the pivot axle or trunnion 32, or alternatively, a torsion spring, not illustrated, may be operatively associated with the pivot axle or trunnion 32 so as to optimally or predeterminedly bias the first lever arm 30 downwardly to the illustrated position.

In either case, and in operation, as illustrated in FIGS. 1 and 4, when a relatively thin piece or unit of mail, or similar article, 24 is conducted downstream by means of the belt conveyor 12 as illustrated in FIG. 1, the relatively thin piece or unit of mail, or similar article, 24 does not materially or substantially cause the lifter wheel 52 to be elevated from, for example, the illustrated position, and accordingly, the various lever arms 48, 44, and 30 will be disposed in their respective illustrated positions such that forming wheel 28 is disposed in contact with the grooved roller 32, not shown in FIG. 1, whereby a reinforcing crease, rib, or spine 38 will be impressed upon such piece or unit of mail, or similar article, 24 as the same is conducted through the nip defined between the forming wheel 28 and the grooved roller 32. Alternatively, as illustrated in FIG. 4, when a relatively thick piece or unit of mail, or similar article, 24' is to be conducted downstream by means of the belt conveyor system 12, it can be readily appreciated that the leading or downstream end of the piece or unit of mail, or similar article or package, 24 will encounter the lifter wheel 52 so as to force the same to be moved upwardly along with a counterclockwise rotational or pivotal movement of the actuating lever arm 48 around the pivot axis defined by axle or trunnion 50. Accordingly, dowel or rod member 54 of actuating lever arm 48 will cause the left end portion of the second lever arm 44 to be elevated whereby the second lever arm 44 is effectively rotated or pivoted in the clockwise direction around its axis defined by axle or trunnion 46. The dowel or rod member 56 of the second lever arm 44 therefore now contacts the left end portion of the first lever arm 30 so as to cause the first lever arm 30 to rotate or pivot in the counterclockwise direction about its axis defined by axle or trunnion 32 whereby forming wheel 28 is elevated to the illustrated position at which forming wheel 28 will be disposed entirely out of contact with the grooved roller 32. In this manner, the relatively thick piece or unit of mail, or similar article or package, 24' will proceed downstream without having a reinforcing crease, rib, or spine impressed or formed therein, and in addition, the conveyance of such relatively thick unit or piece or mail, or similar article or package, 24' does not hinder the free and continuous serial flow of the pieces or units of mail, or similar articles, 24.

Figure 5:
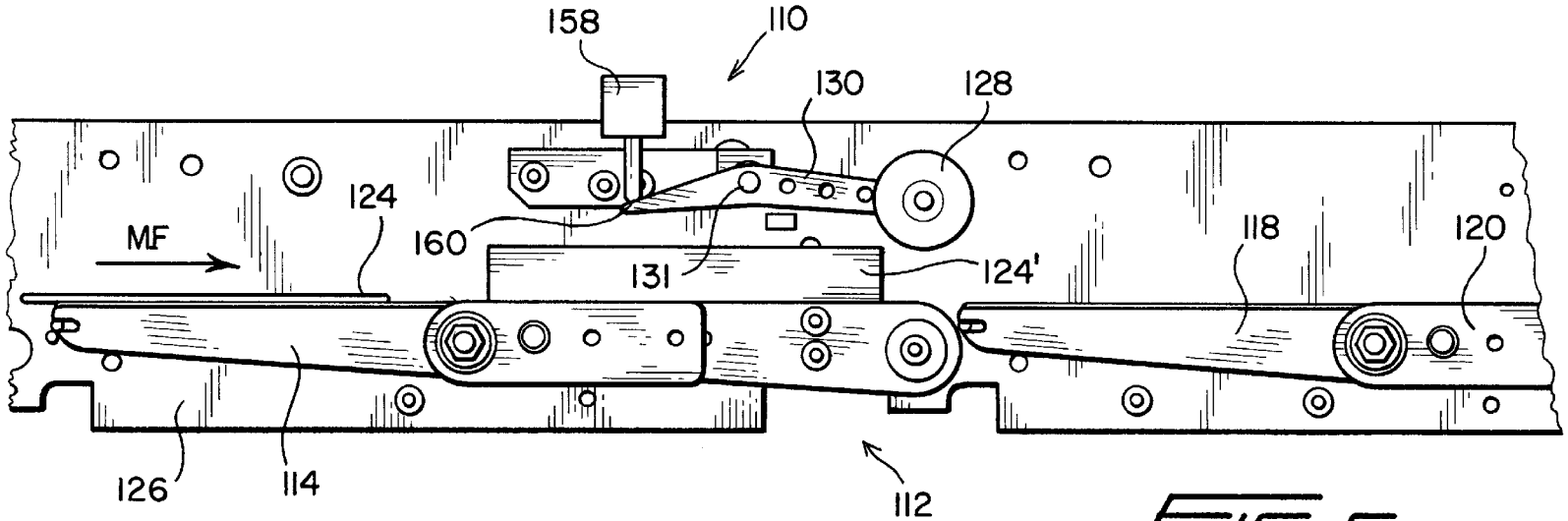
FIG. 5 is a right side elevational view similar to those of FIGS. 1 and 4 showing, however, a second embodiment of a lift mechanism for raising or elevating the forming wheel when a relatively thick unit or piece of mail, or similar article, is being transported or conveyed along the belt conveyor.

With reference lastly being made to FIG. 5, a second alternative embodiment of a new and improved article conveyor or transportation system, which has been developed in accordance with the principles and teachings of the present invention, is disclosed and is generally indicated by the reference character 110. It is noted that this second embodiment system 110 is identical to the first embodiment system 10 disclosed within FIGS. 1 and 4 except for the structure or system of components used to actuate the forming wheel 28 with respect to the conveyance of a relatively thick piece or unit of mail, or similar article or package, 24. Accordingly, all component parts of the system 110 which correspond to the component parts of the system 10 have been designated by corresponding reference characters except that the reference characters are in the 100 series.

More particularly then, it can be seen, as a result of a comparison with the system 10 disclosed within FIG. 4, that the lever actuation system of FIG. 4 has been eliminated and that in lieu thereof, an actuator 158 is operatively associated with the left end portion of the lever arm 130 upon which the forming wheel 128 is mounted. The actuator 158 can be any suitable linear actuator, such as, for example, a solenoid or pneumatic actuator, and when the actuator rod 160 thereof is extended as illustrated in FIG. 5 so as to contact the left end portion of the lever arm 130, lever arm 130 will be rotated or pivoted in the counterclockwise direction so as to elevate forming wheel 128 out of contact with the grooved roller, not shown, and thereby not form or impress a reinforcing crease, rib, or spine upon the relatively thick piece or unit of mail, or similar article or package, 124' whereby the article or package 124' can also freely continue its flow downstream. When the actuator 158 is deactuated, gravitational forces or the spring biasing forces acting upon the lever arm 130 cause the forming wheel 128 to be returned to its normal lowered position in contact with the grooved roller, not shown. It is also to be appreciated that since this actuator system does not comprise, for example, an upstream lifter wheel 52 as in the case of the system disclosed in FIGS. 1 and 4, actuator 158 is preferably actuated by means of suitable upstream sensing devices or mechanisms, not shown, which detect pieces or units of mail, or similar articles or packages, 124' which have a predetermined thickness dimension. The actuator 158 may be suitably mounted upon the support wall 126.

Thus, it may be seen that in accordance with the principles and teachings of the present invention, there has been provided a new and improved article conveyor system wherein a forming wheel is provided for operative cooperation with a grooved roller whereby a relatively shallow and temporary longitudinal crease, rib, or spine is formed or impressed within relatively thin pieces or units of mail, or similar articles, so as to effectively reinforce the piece or unit of mail, or similar article, such that the piece or unit of mail will not experience rollover when, for example, the particular piece or unit of mail, or similar article, is being conveyed from a conveyor mechanism into a stacking or similar accumulation chamber.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A conveyor system, comprising:

a conveyor, defining a conveying surface having an upstream end and a downstream end, and having means for conveying flat articles downstream toward a support surface upon which the articles can be accumulated;

a roller mounted upon said conveyor in addition to said conveying means and having an annular groove formed within an outer peripheral surface portion of said roller; and a forming wheel operatively associated with said conveyor and having an outer peripheral surface disposed in contact with said annular groove of said roller so as to form a temporary, relatively shallow longitudinal crease within the articles, as a result of the articles being conveyed by said conveyor and passed through a nip defined between said outer peripheral surface of said forming wheel and said annular groove of said roller, such that the relatively shallow longitudinal creases longitudinally reinforce the articles so as to ensure that the articles do not experience curling and rollover, and that the articles can therefore be deposited upon the support surface in a substantially flat state.

2. The conveyor system as set forth in claim 1, wherein:

said conveyor comprises a belt conveyor comprising a plurality of laterally spaced endless conveyor belts, and a roller shaft having a plurality of laterally spaced rollers rotatably mounted upon said roller shaft and about which said plurality of laterally spaced endless conveyor belts are routed; and said roller, having said groove formed within said outer peripheral surface thereof, is interposed between a pair of said laterally spaced rollers disposed upon said roller shaft of said belt conveyor and around which a pair of said plurality of laterally spaced endless conveyor belts are disposed.

3. The conveyor system as set forth in claim 1, wherein:

said conveyor comprises a belt conveyor.

4. The conveyor system as set forth in claim 3, wherein:

said belt conveyor comprises a plurality of laterally spaced endless conveyor belts;

said belt conveyor comprises a roller shaft having a plurality of laterally spaced rollers rotatably mounted upon said roller shaft and about which said plurality of laterally spaced endless conveyor belts are routed; and said roller, having said groove formed within said outer peripheral surface thereof, comprises one of said laterally spaced rollers disposed upon said roller shaft of said belt conveyor.

5. The conveyor system as set forth in claim 1, wherein:

said conveyor comprises a support wall; and said forming wheel is movably mounted upon said support wall for movement between a first position at which said forming wheel is disposed in contact with said roller so as to form a reinforcing crease within a conveyed article, and a second position at which said forming wheel is disposed out of contact with respect to said roller so as not to form a reinforcing crease within a conveyed article.

6. The conveyor system as set forth in claim 5, further comprising:

an actuating system for moving said forming wheel between said first and second positions.

7. The conveyor system as set forth in claim 6, wherein said actuating system comprises:

a lever arm upon a first end of which said forming wheel is rotatably mounted; and an actuator operatively engageable with a second end of said lever arm for moving said forming wheel between said first and second positions.

8. The conveyor system as set forth in claim 7, wherein:

said actuator comprises a linear actuator which is selected from the group comprising a solenoid-type actuator and a pneumatic-type actuator.

9. The conveyor system as set forth in claim 6, wherein:

said actuating system moves said forming wheel to said second position at which said forming wheel is disposed out of contact with respect to said roller as a function of the thickness dimensions of the articles being conveyed by said conveyor.

10. The conveyor system as set forth in claim 9, wherein:

said actuating system moves said forming wheel to said second position at which said forming wheel is disposed out of contact with respect to said roller when the thickness dimension of a conveyed article has a predetermined value.

11. The conveyor system as set forth in claim 9, wherein:

said actuating system moves said forming wheel to said second position at which said forming wheel is disposed out of contact with respect to said roller when the thickness dimension of a conveyed article is more than three-sixteenths of an inch (3/16").

12. The conveyor system as set forth in claim 6, wherein said actuating system comprises:

a first lever upon a first end of which said forming wheel is rotatably mounted;

an actuating lever upon a first end of which a lifter wheel is rotatably mounted; and a second lever operatively interconnecting said actuating lever and said first lever such that when said lifter wheel encounters a relatively thick article being conveyed, upward movement of said actuating lever causes movement of said second and first levers whereupon said forming wheel is moved out of contact with respect to said roller.

13. The conveyor system as set forth in claim 12, wherein:

said first lever is pivotally mounted at a substantially central portion thereof upon said support wall;

said second lever is pivotally mounted at a substantially central portion thereof upon said support wall such that a first end of said second lever is operatively engageable with a second end of said first lever; and said actuating lever is pivotally mounted at a second end thereof such that an intermediate portion thereof is operatively engageable with a second end of said second lever, whereupon counterclockwise movement of said actuating lever, as a result of encountering one of the conveyed articles, causes clockwise movement of said second lever which in turn causes counterclockwise movement of said first lever so as to move said forming wheel out of contact with respect to said roller.

14. A conveyor system, comprising:

a conveyor defining a conveying surface having an upstream end and a downstream end, and having means for conveying flat articles downstream toward a support surface upon which the articles can be accumulated;

a roller mounted upon said conveyor and having an annular groove formed within an outer peripheral surface portion of said roller;

a forming wheel operatively associated with said conveyor and having an outer peripheral surface disposed in contact with said annular groove of said roller so as to form a temporary, relatively shallow longitudinal crease within the articles, as a result of the articles being conveyed by said conveyor and passed through a nip defined between said outer peripheral surface of said forming wheel and said annular groove of said roller, such that the relatively shallow longitudinal creases longitudinally reinforce the articles so as to ensure that the articles do not experience curling and rollover and can be deposited upon the support surface in a substantially flat state; and means for moving said forming wheel between a first position at which said forming wheel is disposed in contact with said roller so as to form a reinforcing crease within a conveyed article, and a second position at which said forming wheel is disposed out of contact with respect to said roller so as not to form a reinforcing crease within a conveyed article.

15. The conveyor system as set forth in claim 14, further comprising:

an actuating system for moving said forming wheel between said first and second positions.

16. The conveyor system as set forth in claim 15, wherein:

said actuating system moves said forming wheel to said second position at which said forming wheel is disposed out of contact with respect to said roller as a function of the thickness dimensions of the articles being conveyed by said conveyor.

17. The conveyor system as set forth in claim 15, wherein said actuating system comprises:

a first lever upon a first end of which said forming wheel is rotatably mounted;

an actuating lever upon a first end of which a lifter wheel is rotatably mounted; and a second lever operatively interconnecting said actuating lever and said first lever such that when said lifter wheel encounters a relatively thick article being conveyed, upward movement of said actuating lever causes movement of said second and first levers whereupon said forming wheel is moved out of contact with respect to said roller.

18. The conveyor system as set forth in claim 17, wherein:

said conveyor comprises a support wall;

said first lever is pivotally mounted at a substantially central portion thereof upon said support wall;

said second lever is pivotally mounted at a substantially central portion thereof upon said support wall such that a first end of said second lever is operatively engageable with a second end of said first lever; and said actuating lever is pivotally mounted at a second end thereof such that an intermediate portion thereof is operatively engageable with a second end of said second lever, whereupon counterclockwise movement of said actuating lever, as a result of encountering one of the conveyed articles, causes clockwise movement of said second lever which in turn causes counterclockwise movement of said first lever so as to move said forming wheel out of contact with respect to said roller.

19. The conveyor system as set forth in claim 15, wherein said actuating system comprises:

a lever arm upon a first end of which said forming wheel is rotatably mounted; and an actuator operatively engageable with a second end of said lever arm for moving said forming wheel between said first and second positions.

20. The conveyor system as set forth in claim 19, wherein:

said actuator comprises a linear actuator which is selected from the group comprising a solenoid-type actuator and a pneumatic-type actuator.

* * * * *